United States Patent [19]

Cranney et al.

[11] Patent Number: 4,960,475

[45] Date of Patent: Oct. 2, 1990

[54] SURFACTANT FOR GASSED EMULSION EXPLOSIVE

[76] Inventors: Don H. Cranney, 10535 S. Featherwood, South Jordan, Utah 84065; Blake T. Maxfield, 6614 S. 5095 West, West Jordan, Utah 84084

[21] Appl. No.: 496,008

[22] Filed: Mar. 20, 1990

[51] Int. Cl.[5] ..... C06B 45/00

[52] U.S. Cl. ..... 149/2; 149/46; 149/61; 149/109.6

[58] Field of Search ..... 149/2, 109.6, 46, 61

[56] References Cited

U.S. PATENT DOCUMENTS

| | | | |
|---|---|---|---|
| 3,919,016 | 11/1975 | Dubrow | 149/60 |
| 4,384,903 | 5/1983 | Enever | 149/60 |
| 4,736,683 | 4/1988 | Bachman et al. | 149/60 |

*Primary Examiner*—Stephen J. Lechert, Jr.

[57] ABSTRACT

The present invention relates to an improved explosive composition. More particularly, the invention relates to a water-in-oil emulsion explosive that is sensitized by chemically formed gas bubbles. The water-in-oil emulsion explosives of this invention contain a water-immiscible organic fuel as the continuous phase, an emulsified inorganic oxidizer salt solution as the discontinuous phase, an emulsifier, a chemical gassing agent and a surfactant for increasing the rate of gas generation from the gassing agent. The invention also relates to a method of forming such explosives. As used herein, the term "water-in-oil" will refer to a discontinuous phase of polar or water-miscible droplets emulsified throughout a nonpolar or water-immiscible continuous phase. Such emulsions may or may not actually contain water, and those not containing water sometimes are referred to as "melt-in-oil" emulsions.

16 Claims, No Drawings

SURFACTANT FOR GASSED EMULSION EXPLOSIVE

BACKGROUND OF THE INVENTION

Water-in-oil emulsion explosives are well-known in the art. They are fluid when formed (and can be designed to remain fluid at temperatures at use) and are used in both packaged and bulk forms. They commonly are mixed with ammonium nitrate prills and or ANFO to form a "heavy ANFO" product, having higher energy and depending on the ratios of components, better water resistance than ANFO. Such emulsions normally are reduced in density by the addition of gas or air voids in the form of hollow microspheres or gas bubbles, which materially sensitize the emulsion to detonation. A uniform, stable dispersion of the microspheres or gas bubbles is important to the detonation properties of the emulsion. Gas bubbles, if present, normally are produced by the reaction of chemical gassing agents.

Chemically gassed water-in-oil emulsion explosives are well-known in the art. See, for example, U.S. Pat. Nos. 4,141,767; 4,216,040; 4,426,238; 4,756,777; 4,790,890 and 4,790,891. Chemical gassing agents normally are soluble in the inorganic oxidizer salt or discontinuous phase of the emulsion and react chemically in the oxidizer salt phase under proper pH conditions to produce a fine dispersion of gas bubbles throughout the emulsion. The timing of the addition of the gassing agent is important. The gassing agent or portion thereof that decomposes or reacts chemically in the oxidizer salt solution generally cannot be added to the oxidizer salt solution prior to formation of the emulsion or gassing would occur prematurely. Similarly, if an emulsion is to be subjected to further handling procedures, such as pumping into a borehole or mixing with ammonium nitrate prills or ANFO, then the chemical gassing reaction should not occur fully until after such handling occurs in order to minimize coalescence and/or escape of the gas bubbles. Further, after final placement of the explosive into a borehole, package or other receptacle, gassing should progress to completion in a desired time frame for the specific application or subsequent activities such as cooling, packaging or borehole stemming could interfere with the desired density reduction. Thus the gassing timing and rate must be optimized for a given application.

Since the gassing agent generally is added after the emulsion has been formed, the gassing agent must find its way into or otherwise combine with the discontinuous phase (oxidizer salt phase) of the emulsion in order to decompose or react chemically to produce gas bubbles. Thus it is important that the gassing agent be dispersed quickly and homogeneously throughout the emulsion. The ease by which the gassing agent finds its way into the oxidizer salt phase depends on the stability of the emulsion and on the type of emulsifier used. With a more stable emulsion and/or with particular types of emulsifiers, it is more difficult and thus takes longer or requires more mixing or shearing action to mix uniformly and combine the gassing agent solution with the oxidizer phase of the emulsion and thereby obtain gassing at a sufficiently high rate. This particularly is the case when polymeric emulsifiers are used, such as polyalkenyl succinic acid esters and amides, polyalkenyl phenolic derivatives and the like. These types of emulsifiers tend to form highly stable emulsions. Polymeric emulsifiers of this type are described in U.S. Pat. Nos. 4,357,184; 4,708,753; 4,784,706; 4,710,248; 4,820,361; 4,822,433; and 4,840,687. As used herein the term "polymeric emulsifier" shall mean any emulsifier wherein the lipophillic portion of the molecule is composed of a polymer derived from the linking of two or more monomers.

It has been found in the present invention that the addition of a surfactant that is soluble in the oxidizer salt phase, concurrently with the addition of the chemical gassing agent, significantly increases the rate of gas generation from the chemical gassing agent. The surfactant can be conveniently dissolved in the gassing agent solution. It can also be added as a separate solution or combined with another aqueous miscible more fully below, it is believed that the surfactant enables the gassing agent to enter the discontinuous phase more quickly, easily and uniformly, which thus allows the chemical gassing reaction to proceed at a faster rate.

SUMMARY OF THE INVENTION

The invention comprises the addition of a surfactant to a water-in-oil emulsion explosive having an organic fuel as a continuous phase, an inorganic oxidizer salt solution as a discontinuous phase, an emulsifier and a chemical gassing agent. The surfactant has been found to increase the ease and the uniformity of incorporating the gassing agent into an already formed emulsion, thereby increasing the rate of gas generation within the emulsion.

DETAILED DESCRIPTION OF THE INVENTION

As indicated above, a chemical gassing agent generally is added after the emulsion is formed. The timing of addition is such that gassing will occur after or about the same time as further handling of the emulsion is completed so as to minimize loss, migration and/or coalescence of gas bubbles. As the gassing agent is added and blended throughout the emulsion, the gassing agent, which preferably comprises nitrite ions, starts to react with ammonium ions or other substrates present in the oxidizer salt solution (dispersed in the emulsion as droplets) according to reactions such as the following:

$$NO_2^- + NH_4^+ \rightarrow N_2 + H_2O$$

Normally, the speed of the foregoing reaction between nitrite and ammonium ions depends on various solution parameters such as temperature, pH and reactant concentrations. The pH should be controlled within the range of from about 2.0 to about 5.0, depending on the desired gassing rate. The temperature may vary from an elevated formulation temperature of about 80° -90° C. course proceeds faster at higher temperatures. Other factors that have been found to determine the rate of the reaction are the stability of the emulsion, the type of emulsifier used, and the intensity of mixing.

Although many factors affect the stability of the emulsion, perhaps the major factor is the type of emulsifier used. Typical emulsifiers include sorbitan fatty esters, glycol esters, substituted oxazolines, alkylamines or their salts, derivatives thereof and the like. More recently, certain polymeric emulsifiers have been found to impart better stability to emulsions under certain conditions. U.S. Pat. No. 4,820,361 describes a polymeric emulsifier derivatized from trishydroxymethylaminomethane and polyisobutenyl succinic anhydride, and U.S. Pat. No. 4,784,706 discloses a phenolic derivative of polypropene or polybutene. Other patents have disclosed other derivatives of polypropene or polybutene. Preferably the polymeric emulsifier comprises an alkanolamine or polyol derivative of a carboxylated or anhydride derivatized olefinic or vinyl addition polymer. Most preferably, commonly assigned and copending U.S. Ser. No. 07/318,768 discloses a polymeric emulsifier comprising a bis-alkanolamine or bis-polyol derivative or a bis-carboxylated or anhydride derivatized olefinic or vinyl addition polymer in which the olefinic or vinyl addition polymer chain has an average chain length of from about 10 to about 32 carbon atoms, excluding side chains or branching.

The increased stability of an emulsion explosive containing a polymeric emulsifier generally means that the interface is more stable between the internal or discontinuous oxidizer salt solution phase and the continuous or external organic liquid phase. Since the chemical gassing agent is added after the emulsion is formed, and since it must find its way into the internal phase before it will react to produce gas bubbles, the more stable the interface the more difficult it is for the gassing agent to enter the internal phase. Two possible mechanisms can be used to explain the mass transport of the gassing agent into the internal phase, although the following discussion of these mechanisms is not intended to limit the present invention with respect to any theoretical considerations. Firstly, when added to and mixed homogeneously throughout the emulsion, the gassing agent may physically enter the internal phase as such phase is exposed due to the shearing action of the mixing. Secondly, the water soluble gassing agent, as it is added to the emulsion, could be emulsified throughout the continuous or external phase as separate droplets. The reactants from these droplets then could enter the internal phase (or vice versa) by diffusion. A combination of these two mechanisms also is possible.

It has been found in the present invention that if a water soluble surfactant is combined with or added along with the gassing agent, the gassing agent more easily penetrates or combines with the internal phase of the emulsion when subjected to the mixing or shearing action. This significantly increases the gassing rate in the emulsion, which is particularly advantageous with emulsions that are gassed at ambient (or low) temperatures at which gassing rates typically are slow. Without limiting the present invention with respect to any theoretical considerations, a possible explanation for this effect is that the surfactant interacts directly with the interface between the oil phase and aqueous solution phase within the emulsion to cause a localized inversion (to oil-in-water micelles) or other physical disruption of the interfaces within the emulsion thereby allowing easier, more rapid and more uniform mixing of the gassing agent and the oxidizer salt solution. Another possible the gassing agent ions in the additive solution and acts as a carrier through the continuous phase of the emulsion thereby enhancing the diffusion of the gassing agent into the discontinuous phase or vice versa. Both or other mechanisms could be occurring. Regardless of the actual mechanism at work, the addition of a water soluble surfactant with the water soluble chemical gassing agent greatly enhances the gassing rate of a water-in-oil emulsion explosive containing a polymeric emulsifier. The surfactant may be nonionic, cationic, anionic or amphoteric. The surfactant must be sufficiently soluble or dispersible in the oxidizer salt solution and must not destabilize the final gassed emulsion. Only a small amount of surfactant is needed, generally less than 1% by weight of the emulsion composition. Preferably, the surfactant is selecting from the group consisting of:

(a) sulfonates or sulfates of alkanes, aromatics, alkyl aromatics, olefins, lignins, amines, alcohols and ethoxylated alcohols;

(b) alkyl, aryl, alkyl aryl and olefin esters of glycol, glycerol, sorbitan, alcohols, polyalcohols and alkanolamines;

(c) phosphate esters and derivatives thereof;

(d) ethoxylates of alcohols, carboxylated alcohols, polypropylene oxide, organic acids (such as fatty acids), amines, amides, sorbitan esters, sulfosuccinates and alkyl phenols;

(e) nitrogen containing surfactants including amines, amine salts, amine oxides, amido amines, alkanol amides, imidazolines, imidazolinium amphoterics and quaternary ammonium salts;

(f) betaines, sultaines, sulfosuccinates, silicone based surfactants, fluorocarbons, isethionates and lignins; and (g) various combinations of the above.

The foregoing listing gives examples of the kinds of surfactants by no means an exhaustive listing, and other aqueous solution soluble or dispersible surfactants familiar to those skilled in the art may be utilized.

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitro-compounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight. If desired, undissolved oxidizer salt can be added to the composition along with any solid or liquid fuels.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate, but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred.

Water generally is employed in an amount of from 3% to about 30% by weight based on the total composition. It is commonly employed in emulsions in an amount of from about 9% to about 20%, although emulsions can be formulated that are essentially devoid of water.

Water-miscible organic liquids can at least partially replace water as a solvent for the salts, and such liquids also function as a fuel for the composition. Moreover, certain organic compounds also reduce the crystallization temperature of the oxidizer salts in solution. Miscible solid or liquid fuels can include alcohols such as sugars and methyl alcohol, glycols such as ethylene glycols, amides such as formamide, amines, amine nitrates, urea and analogous nitrogen-containing fuels. As is well known in the art, the amount and type of water-miscible liquid(s) or solid(s) used can vary according to desired physical properties.

Chemical gassing agents preferably comprise sodium nitrite, that reacts chemically in the composition to produce gas bubbles, and a gassing accelerator such as thiourea, to accelerate the decomposition process. A sodium nitrite/thiourea combination produces gas bubbles immediately upon addition of the nitrite to the oxidizer solution containing the thiourea, which solution preferably has a pH of about 4.5. The nitrite is added as a diluted aqueous solution in an amount of from less than 0.1% to about 0.4% by weight, and the thiourea or other accelerator is added in a similar amount to the oxidizer solution. Additional gassing agents can be employed In addition to chemical gassing agents hollow spheres or particles made from glass, plastic or perlite may be added to provide further density reduction.

The emulsion of the present invention may be formulated in a conventional manner, until the time for addition of the gassing agent. Typically, the oxidizer salt(s) first is dissolved in the water (or aqueous solution of water and miscible liquid fuel) at an elevated temperature of from about 25.C to about 90.C or higher, depending upon the crystallization temperature of the salt solution. The aqueous solution, which may contain a gassing accelerator, then is added to a solution of the emulsifier and the immiscible liquid organic fuel, which solutions preferably are at the same elevated temperature, and the resulting mixture is stirred with sufficient vigor to produce an emulsion of the aqueous solution in a oontinuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. When gassing is desired, which could be immediately after the emulsion is formed or up to several months thereafter when it has cooled to ambient or lower temperatures, the gassing agent and surfactant are added and mixed homogeneously throughout the emulsion to produce uniform gassing at the desired rate. The solid ingredients, if any, can be added along with the gassing agent and surfactant and stirred throughout the formulation by conventional means. Packaging and/or further handling should quickly follow the addition of the gassing agent, depending upon the gassing rate, to prevent loss or coalescence of gas bubbles. The formulation process also can be accomplished in a continuous manner as is known in the art.

It has been found to be advantageous to predissolve the emulsifier in the liquid organic fuel prior to adding the organic fuel to the aqueous solution. This method allows the emulsion to form quickly and with minimum agitation. However, the emulsifier may be added separately as a third component if desired.

Reference to the following Table further illustrates the invention. Examples 1 and 2 compare the effect of the gassing surfactant in an emulsion explosive containing a sorbitan monooleate emulsifier. The surfactant reduced the gassing time from 26 minutes to 3.5 minutes. Examples 3–5 compare the effect of a surfactant in emulsion explosives containing a polymeric emulsifier. The gassing time went from approximately 480 minutes (Example 3) to 14 and 11 minutes (Examples 4 and 5, respectively). Examples 5, 6 and 9 contained the same emulsion but were gassed with different surfactant additives. Examples 7 and 8 illustrate the effect of using different amounts of a surfactant additive. These examples all had emulsions made from polymeric emulsifiers that were gassed with a combination of nitrite gassing agent and a gassing surfactant and consequently had relatively low gassing times.

Example 10 was made from a larger molecular weight polymeric emulsifier, did not have a gassing surfactant and consequently had a longer gassing time. In contrast, Example 11 shows the same emulsion gassed with a surfactant additive, and consequently the gassing time was reduced thirty-fold.

The examples in the Table also demonstrate the functionality of different classes of aqueous solution soluble surfactants, i.e., Example 5 contained a nonionic surfactant; Examples 2, 6, 7, 8, 11 contained anionic surfactants; Example 4 contained a cationic surfactant and Example 9 contained an amphoteric surfactant. The main criteria for use is that the surfactant be sufficiently soluble or dispersible in the trace additive solution it is combined with for addition to the emulsion and that it have no intolerable destabilizing effects at its final concentration in the emulsion.

While the present invention has been described with reference to certain illustrative examples and preferred embodiments, various modifications will be apparent to those skilled in the art and any such modifications are intended to be within the scope of the invention as set forth in the appended claims.

TABLE I

| | 1 | 2 | 3 | 4 | 5 | 6 | 7 | 8 | 9 | 10 | 11 |
|---|---|---|---|---|---|---|---|---|---|---|---|
| Emulsion | | | | | | | | | | | |
| Ammonium Nitrate | 63.1 | 63.1 | 63.1 | 63.1 | 63.1 | 63.1 | 63.1 | 63.1 | 63.1 | 63.1 | 63.1 |
| Calcium Nitrate | 11.0 | 11.0 | 11.0 | 11.0 | 11.0 | 11.0 | 11.0 | 11.0 | 11.0 | 11.0 | 11.0 |
| Water | 18.9 | 18.9 | 18.9 | 18.9 | 18.9 | 18.9 | 18.9 | 18.9 | 18.9 | 18.9 | 18.9 |
| Acetic Acid | 0.2 | 0.2 | 0.2 | 0.2 | 0.2 | 0.2 | 0.2 | 0.2 | 0.2 | 0.2 | 0.2 |
| Sorbitan Mono Oleate | 1.4 | 1.4 | | | | | | | | | |
| Polyisobutenyl (MW = 920) Succinic Acid Amide | | | | | | | | | | 1.4 | 1.4 |

TABLE I-continued

| | 1 | 2 | 3 | 4 | 5 | 6 | 7 | 8 | 9 | 10 | 11 |
|---|---|---|---|---|---|---|---|---|---|---|---|
| Polyisobutenyl (MW = 563) Succinic Acid Amine | | | 1.4 | 1.4 | 1.4 | 1.4 | 1.4 | 1.4 | 1.4 | | |
| Gassing Catalyst/Accelerator[1] | 0.3 | 0.3 | 0.3 | 0.3 | 0.3 | 0.3 | 0.3 | 0.3 | 0.3 | 0.3 | 0.3 |
| Fuel Oil | 4.2 | 4.2 | 4.2 | 4.2 | 4.2 | 4.2 | 4.2 | 4.2 | 4.2 | 4.2 | 4.2 |
| Mineral Oil | 1.4 | 1.4 | 1.4 | 1.4 | 1.4 | 1.4 | 1.4 | 1.4 | 1.4 | 1.4 | 1.4 |
| Gassing Additives | | | | | | | | | | | |
| Sodium Nitrite | 0.05 | 0.05 | 0.05 | 0.05 | 0.05 | 0.05 | 0.05 | 0.05 | 0.05 | 0.05 | 0.05 |
| Surfactant Gassing Accelerators[2] | | | | | | | | | | | |
| Ethoxylated Nonyl Phenol (non-ionic) | | | | | 0.0025 | | | | | | |
| Sodium Alkyl Naphthalene Sulfonate (anionic) | | 0.0025 | | | | 0.0025 | 0.0013 | 0.0025 | | 0.0025 | |
| Trimethyldodecyl Ammonium Chloride (cationic) | | | | 0.0025 | | | | | | | |
| Cocamidopropyl Hydroxy Sultaine (amphoteric) | | | | | | | | | 0.0025 | | |
| Emulsion Temperature | 20° C. | 20° C. | 20° C. | 20° C. | 20° C. | 20° C. | 20° C. | 20° C. | 20° C. | 20° C. | 20° C. |
| Results | | | | | | | | | | | |
| $T_{90}$ (Minutes)[3] | 26 | 3.5 | ~480 | 14 | 11 | 20 | 20 | 40 | 28 | ~900 | 28 |
| Final Density (g/cc) | 1.10 | 1.10 | — | 1.11 | 1.09 | 1.09 | 1.09 | 1.11 | 1.11 | — | 1.13 |

[1]Thiourea or equivalent.
[2]Surfactant accelerators added with (dissolved in) the sodium nitrite solution such that levels indicated in the overall formulation are obtained.
[3]Time necessary to complete 90% of the gassing reaction when comparative examples are treated in an identical fashion, i.e. gassing solution mixed into 250 g emulsion with Jiffy 1¼" stir blade at 500 rpm.

What is claimed is:

1. A water-in-oil emulsion explosive comprising an organic fuel as a continuous phase; an emulsified inorganic oxidizer salt solution or melt as a discontinuous phase; an emulsifier; a chemical gassing agent soluble in the oxidizer salt solution and a surfactant soluble or dispersible in the oxidizer salt solution for increasing the rate of gas generated by the chemical gassing agent.

2. An explosive according to claim 1 wherein the emulsifier is a polymeric emulsifier.

3. An explosive according to claim 2 wherein the polymeric emulsifier is an alkanolamine or polyol derivative of a carboxylated or anhydride derivatized olefinic or vinyl addition polymer.

4. An explosive according to claim 1 wherein the organic fuel is selected from the group consisting of tall oil; mineral oil; waxes; benzene; toluene; xylene; petroleum distillates such as gasoline, kerosene and diesel fuels; vegetable oil such as corn oil, cotton seed oil, peanut oil and soybean oil; and mixtures thereof.

5. An explosive according to claim 1 wherein the oxidizer salt solution comprises inorganic oxidizer salt in an amount of from about 45% to about 95% by weight of the total composition and water or water-miscible organic liquids in an amount of from about 2% to about 30%.

6. An explosive according to claim 1 wherein the surfactant is selected from the group consisting of:

(a) sulfonates or sulfates of alkanes, aromatics, alkyl aromatics, olefins, lignins, amines, alcohols and ethoxylated alcohols;

(b) alkyl, aryl, alkyl aryl and olefin esters of glycol, glycerol, sorbitan, alcohols, polyalcohols, and alkanolamines;

(c) phosphate esters and derivatives thereof;

(d) ethoxylates of alcohols, carboxylated alcohols, polypropylene oxide, organic acids (such as fatty acids), amines, amides, sorbitan esters, sulfosuccinates and alkyl phenols;

(e) nitrogen containing surfactants including amines, amine salts, amine oxides, amido amines, alkanol amides, imidazolines, imidazolinium amphoterics and quaternary ammonium salts;

(f) betaines, sultaines, sulfosuccinates, silicone based surfactants, fluorocarbons, isethionates and lignins; and (g) various combinations of the above.

7. An explosive according to claim 6 wherein the surfactant is present in an amount of less than about 1%.

8. An explosive according to claim 6 wherein the surfactant is sodium methylnaphthalene sulfonate.

9. An explosive according to claim 5 wherein the oxidizer salt solution additionally contains a gassing accelerator to accelerate the rate of gas generation by the chemical gassing agent.

10. A method for forming a water-in-oil emulsion explosive comprising an organic fuel as a continuous phase, an emulsified inorganic oxidizer salt solution as a discontinuous phase and an emulsifier comprising the steps of (a) forming the emulsion explosive, (b) adding to the emulsion explosive a chemical gassing agent for producing sensitizing gas bubbles throughout the explosive and a surfactant soluble or dispersible in the oxidizer salt solution for increasing the rate of gas generation from the gassing agent, and (c) mixing the gassing agent and surfactant into the emulsion explosive.

11. A method according to claim 10 comprising the additional step of adding a gassing accelerator to accelerate the rate of gas generation.

12. A method according to claim 11 wherein the gassing accelerator is added to the oxidizer salt solution and reacts with the gassing agent upon its addition to accelerate the rate of gas generation.

13. A method according to claim 10 wherein the surfactant is added as a separate solution.

14. A method according to claim 13 wherein the surfactant is dissolved or dispersed in a solution of the gassing agent prior to addition to the emulsion.

15. A method according to claim 13 wherein the surfactant is dissolved or dispersed in a solution of the gassing accelerator prior to addition to the emulsion.

16. A method according to claim 10 wherein the emulsifier is a polymeric emulsifier.

* * * * *